US010454179B1

(12) United States Patent
Kabakian et al.

(10) Patent No.: US 10,454,179 B1
(45) Date of Patent: Oct. 22, 2019

(54) HOLOGRAPHIC ARTIFICIAL IMPEDANCE ANTENNAS WITH FLAT LENS FEED STRUCTURE

(71) Applicant: HRL Laboratories, LLC, Malibu, CA (US)

(72) Inventors: Adour V. Kabakian, Monterey Park, CA (US); Amit M Patel, Santa Monica, CA (US)

(73) Assignee: HRL Laboratories, LLC, Malibu, CA (US)

( * ) Notice: Subject to any disclaimer, the term of this patent is extended or adjusted under 35 U.S.C. 154(b) by 250 days.

(21) Appl. No.: 15/233,899

(22) Filed: Aug. 10, 2016

(51) Int. Cl.
*H01Q 1/48* (2006.01)
*H01Q 13/28* (2006.01)
*H01Q 3/46* (2006.01)

(52) U.S. Cl.
CPC ..... *H01Q 13/28* (2013.01); *H01Q 1/48* (2013.01); *H01Q 3/46* (2013.01)

(58) Field of Classification Search
CPC ..... H01Q 13/28
USPC ..... 343/753
See application file for complete search history.

(56) References Cited

U.S. PATENT DOCUMENTS

| | | | |
|---|---|---|---|
| 7,830,310 | B1 | 11/2010 | Sievenpiper et al. |
| 7,911,407 | B1 | 3/2011 | Fong et al. |
| 7,929,147 | B1 | 4/2011 | Fong et al. |
| 2013/0285871 | A1 | 10/2013 | Gregoire |

*Primary Examiner* — Graham P Smith
(74) *Attorney, Agent, or Firm* — Ladas & Parry

(57) ABSTRACT

Several embodiments of systems and methods are described for a compound structure consisting of a compact conformal surface-wave antenna feed structure attached to a conformal surface-wave antenna. The feed structure is an Artificial Impedance Surface (AIS) which takes as input an arbitrary source, converts it into a desired surface-wave waveform, which then feeds its output into the attached conformal surface-wave antenna for optimal radiation performance.
The feed structure can be made up of several sizes and shapes of AIS metal patches and can produce plane isotropic as well as anisotropic surface-wave output. The surface-wave antenna can be a radiating hologram made up of the same AIS metallic patches as the feed structure and fabricated on the same dielectric substrate.

26 Claims, 20 Drawing Sheets

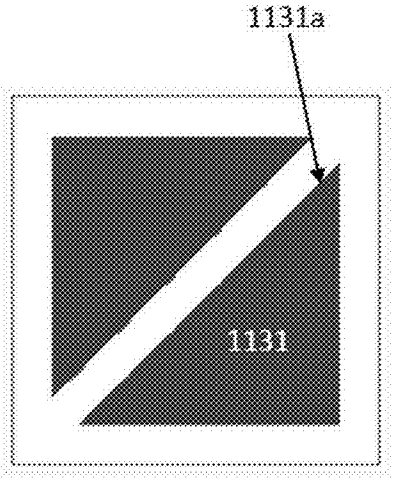
FIG. 12A
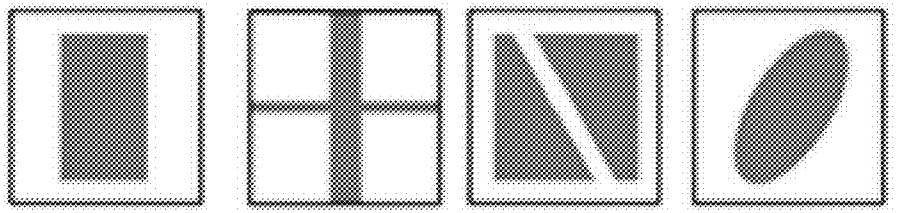
FIG. 12B
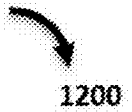

| Design | Surface Currents | Gain (dB) | Aperture Efficiency |
|---|---|---|---|
| | | 21.5 | 9.8% |
| | | 23.6 | 15.7% |
| | | 25.5 | 18.9% 2x improvement |
| | | 25.1 | 22.6% more than 2x improvement 24% size reduction |

HOLOGRAPHIC ARTIFICIAL IMPEDANCE ANTENNAS WITH FLAT LENS FEED STRUCTURE

TECHNICAL FIELD

The present disclosure is directed in general to the field of Artificial Impedance Surface Antennas (AIS). In particular, this invention is in the area of conformal Holographic AIS antennas.

BACKGROUND OF THE DISCLOSURE

The word artificial refers to the electromagnetic properties of homogeneous surfaces and materials that are not naturally observed in nature. The macroscopic electromagnetic properties of these homogeneous materials are determined by their microscopic structures. Therefore it is convenient to call these surfaces and materials also as metasurfaces and metamaterials, which are the common names in the literature for the surfaces and materials.

An artificial impedance surface can be created by metal patterning on a dielectric surface above a ground plane. By varying the local size and spacing of the metal patterning, specific reactive impedance values can be obtained. To scatter a given excitation from the artificial impedance surface into a desired far field pattern, one can use a holographic technique to determine the required space-dependent impedance function, and in turn the local metal patterning necessary to create the desired impedance function.

In the area of holographic antennas, holograms are built from cylindrical surface waves generated by point-sources, leading to low efficiency. In addition, reflections from the edges of the surface do not radiate in the prescribed direction. The described approach in U.S. Pat. No. 7,929,147 B1 revises the prescribed surface impedance distribution in U.S. Pat. Nos. 7,911,407 and 7,830,310 B1 to account for edge reflections, but achieves only moderate improvements in efficiency since the hologram is still essentially built from cylindrical surface waves as the source, and modifying the hologram to account for the edge reflections necessarily reduces the efficiency for radiating the initial cylindrical wave front. The design in US 2013/0285871 A1 achieves the goal of generating a 2D surface plane wave from a point-source, however it captures only a small fraction of the source energy and it adds significantly to the size of the antenna. It uses a long tapered transmission line as a feed, but its length can easily be multiple times that of the actual antenna, limiting its practical usefulness.

The prior art techniques suffer from poor efficiency in the transformation of source energy to radiated energy, require relatively larger feed and/or radiating surface and suffer from beam distortions due to edge reflections from the radiating surface. In addition, the prior art techniques suffer from poor control in focusing the radiated energy in the prescribed direction of radiation.

Therefore, there is an urgent need to improve the performance of conformal holographic AIS antennas to make them more viable for commercial applications with improved efficiency, simplicity and compactness.

SUMMARY OF THE DISCLOSURE

To address one or more of the above-deficiencies of the prior art, an embodiment described in this disclosure improves the performance of conformal holographic Artificial Impedance Surface (AIS) antennas driven by a single point-source by using a flat lens feed structure that transforms the cylindrical surface-wave of the source into a surface plane wave that is then fed into a longitudinally modulated holographic surface for optimal radiation. In other embodiments, by using a compound structure consisting of a surface-wave lens attached to a one-dimensionally modulated radiation strip, the performance over the traditional two-dimensional modulated hologram approach is significantly improved. Yet another embodiment of this invention further improves the performance by using a novel, anisotropic compact surface-wave flat lens that takes less space than an isotropic lens, allowing the use of a larger radiating section for increased efficiency without increasing total antenna size.

An embodiment of this invention discloses a conformal surface-wave feed structure, comprising one or more source feed(s), and one or more conformal surface-wave flat lens section(s) connected to the source feed(s), wherein the flat lens section(s) converts the source feed(s) to a plane surface wave.

Another embodiment of this invention is a compound structure comprising one or more conformal surface-wave flat lens section(s) connected to one or more source feed(s) on one end, and one or more surface-wave antenna(s) connected to the other end of the flat lens section(s), wherein the flat lens section(s) converts the source feed(s) to one or more plane surface-waves.

Another embodiment is a method of making a compound structure comprising, mounting a dielectric substrate on a ground plane that is conformal to a mounting surface, mounting metal patches made up of Artificial Impedance Surface (AIS) materials, and applying a protective coating, wherein the metal patches are laid out to serve as a flat lens section cascaded with a holographic one dimensionally modulated antenna section, and wherein the substrate is monolithic. There are various types of protective coatings available and known to those skilled in the art. One or more of these protective coatings can be used based on the needs of the application environment. The rain erosion coating typically uses thin conventional rain erosion coating, with thickness typically less than 0.0020 inch. The antistatic coating may be used to bleed accrued static charge. Honeycomb type material may be used to increase strength. Polyurethane tapes and boots may be used for protection and strength as well. Other dielectric layers may also be used with low electric loss and high mechanical strength to properly compensate for various incident angles and polarizations. The term monolithic substrate is well known to those skilled in the art. In this context, it includes a single crystal as a substrate on which the flat lens section and the holographic modulated antenna section are laid out.

An embodiment of this disclosure discloses a method of realizing the isotropic impedance distribution, comprising computing the desired lensing function, selecting size, shape and material of AIS unit cells, and computing gaps between unit cells and the number of unit cells needed to realize the desired lensing function, and laying the unit cells in a shape necessary to provide the necessary isotropic impedance function on a dielectric substrate, wherein the lensing function transforms a source wave to a plane surface-wave.

Yet another embodiment discloses a conformal compound surface comprising, a planar surface wave AIS flat lens attached to a point source at one end, and a AIS radiating hologram attached to the other end of the flat lens, wherein both the flat lens and the radiating hologram are made up of metal patches of various sizes and wherein the flat lens converts the point source feed to a plane surface wave.

The concept structures disclosed herein, such as the compact conformal MS surface-wave feed structure which can transform an arbitrary feed into an arbitrary surface-wave wave-front that feeds a surface-wave antenna to significantly increase its performance, as well as the compound structure consisting of the AIS feed structure and any type of conformal surface-wave antenna attached to it, can be implemented in a variety of ways to meet the specific needs of the various applications.

Certain embodiments may provide specific technical features depending on the implementation. For example, a technical feature of some embodiments may include the capability for increased radiation surface without increasing the overall size of the antenna. Other embodiments may focus on efficiency in converting source energy to radiated energy. In yet another embodiment, focus may be to eliminate/reduce effects of edge reflections and/or in fine control of keeping the radiated energy in the prescribed direction of radiation.

Although specific features have been enumerated above, various embodiments may include some, none, or all of the enumerated features. Additionally, other technical features may become readily apparent to one of ordinary skill in the art after review of the following figures and description.

For a more complete understanding of the present disclosure and its features, reference is now made to the following description taken in conjunction with the accompanying drawings, in which like reference numerals represent like parts:

FIG. 1 illustrates surface-wave traveling over a surface. The wave, represented by red and blue contours, essentially exists only very close to the surface, with its amplitude decaying exponentially away from the surface. Even when the surface is curved, such a wave can be viewed as a two-dimensional wave with a very compressed third dimension;

FIG. 7A illustrates the perspective view and FIG. 78 illustrates the top view of an ideal one-dimensional surface impedance modulation in the prescribed radiation direction, according to an embodiment of the present disclosure;

Figures 11A, 11B:
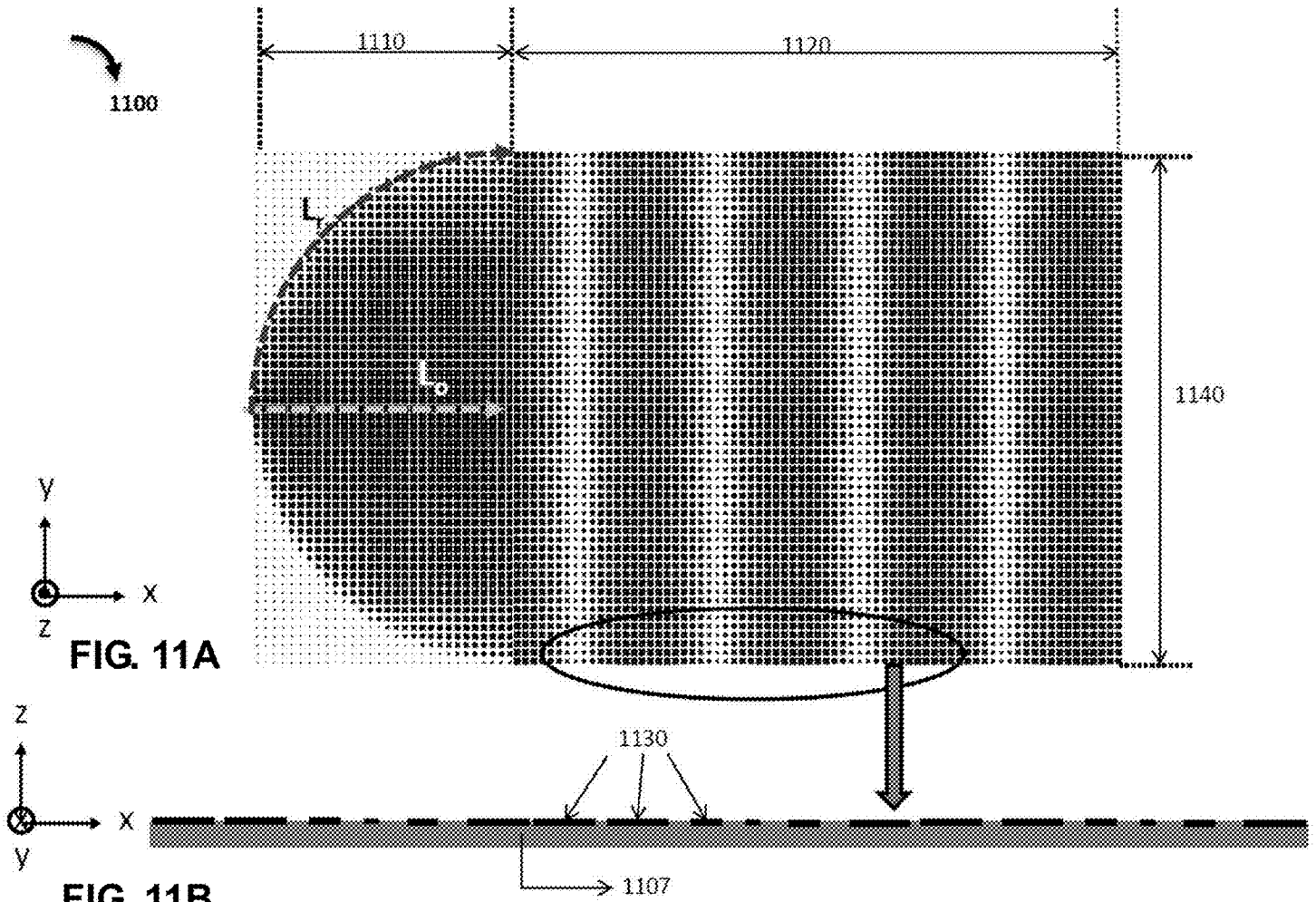
Figures 13A, 13B:
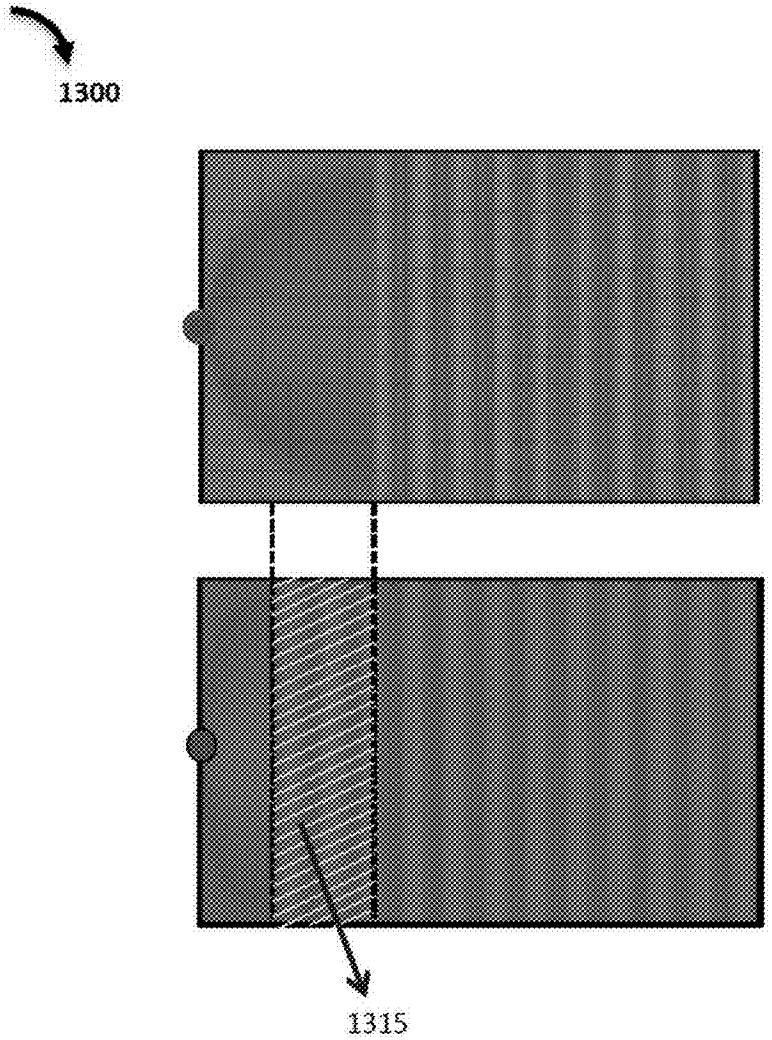
Figure 14:
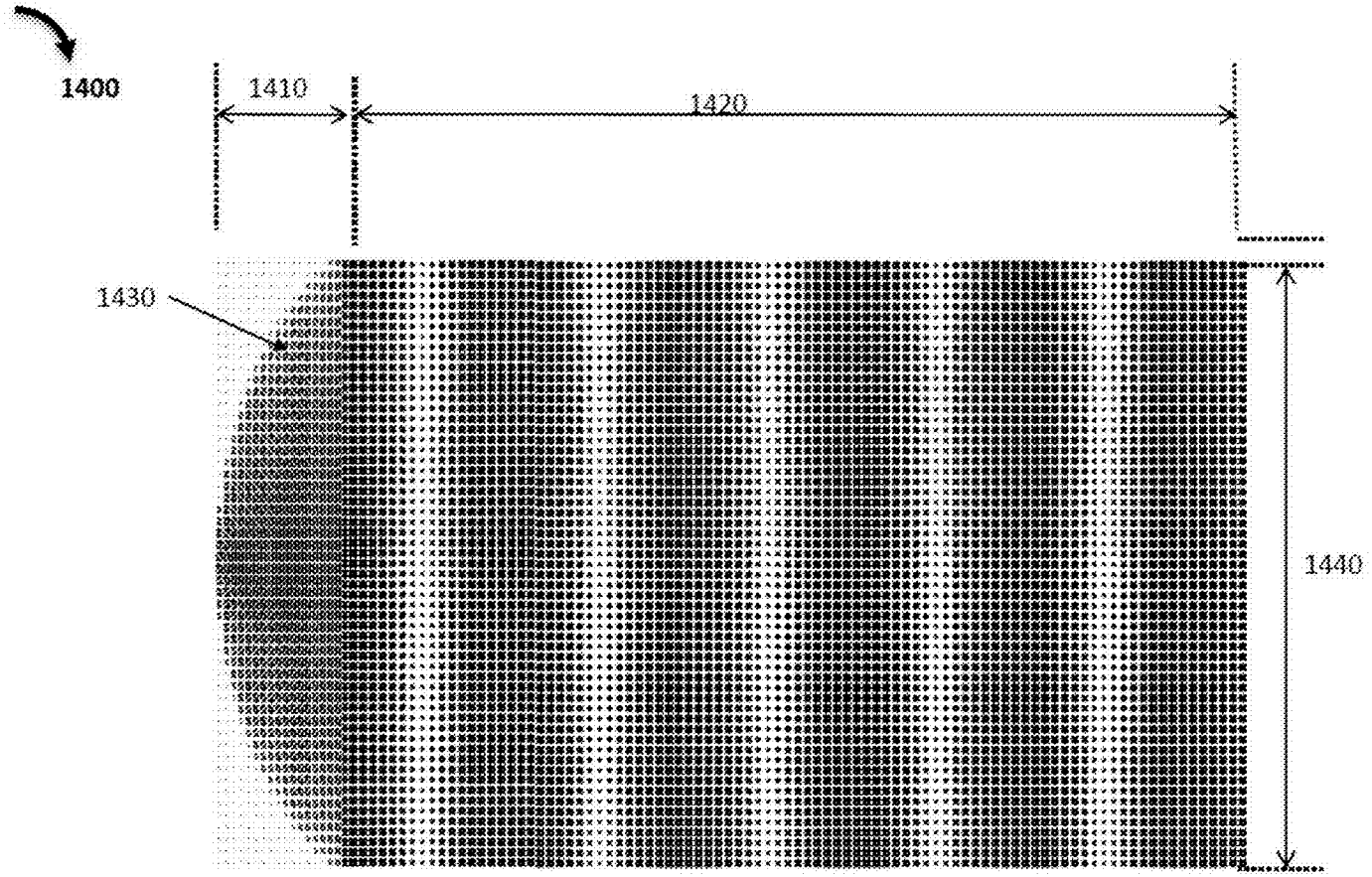
Figures 15A, 15B:
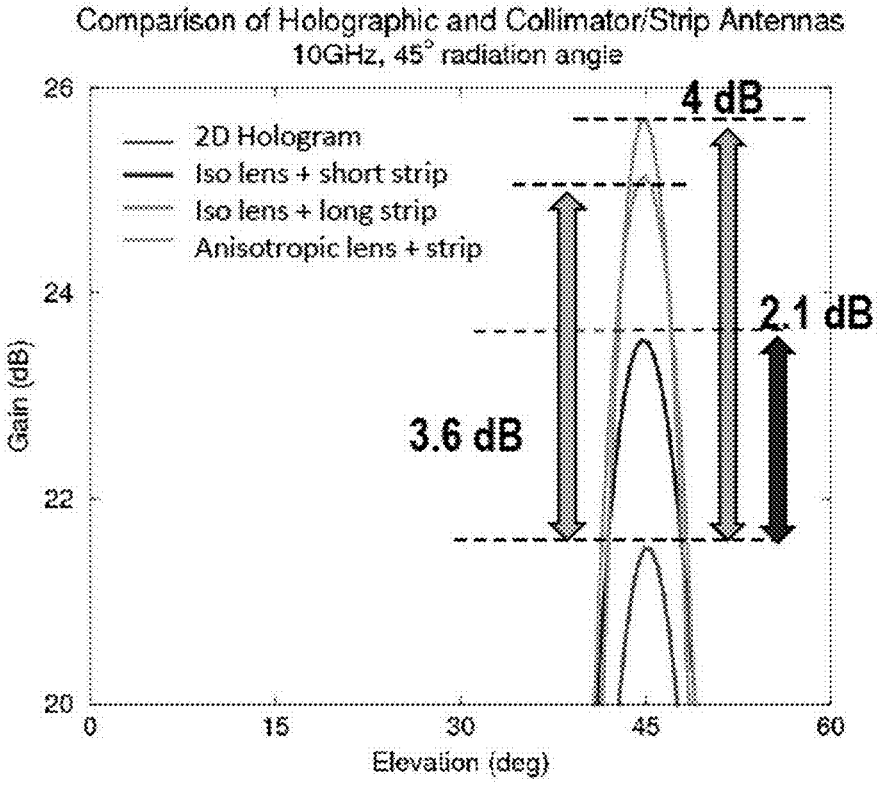
Figure 16:
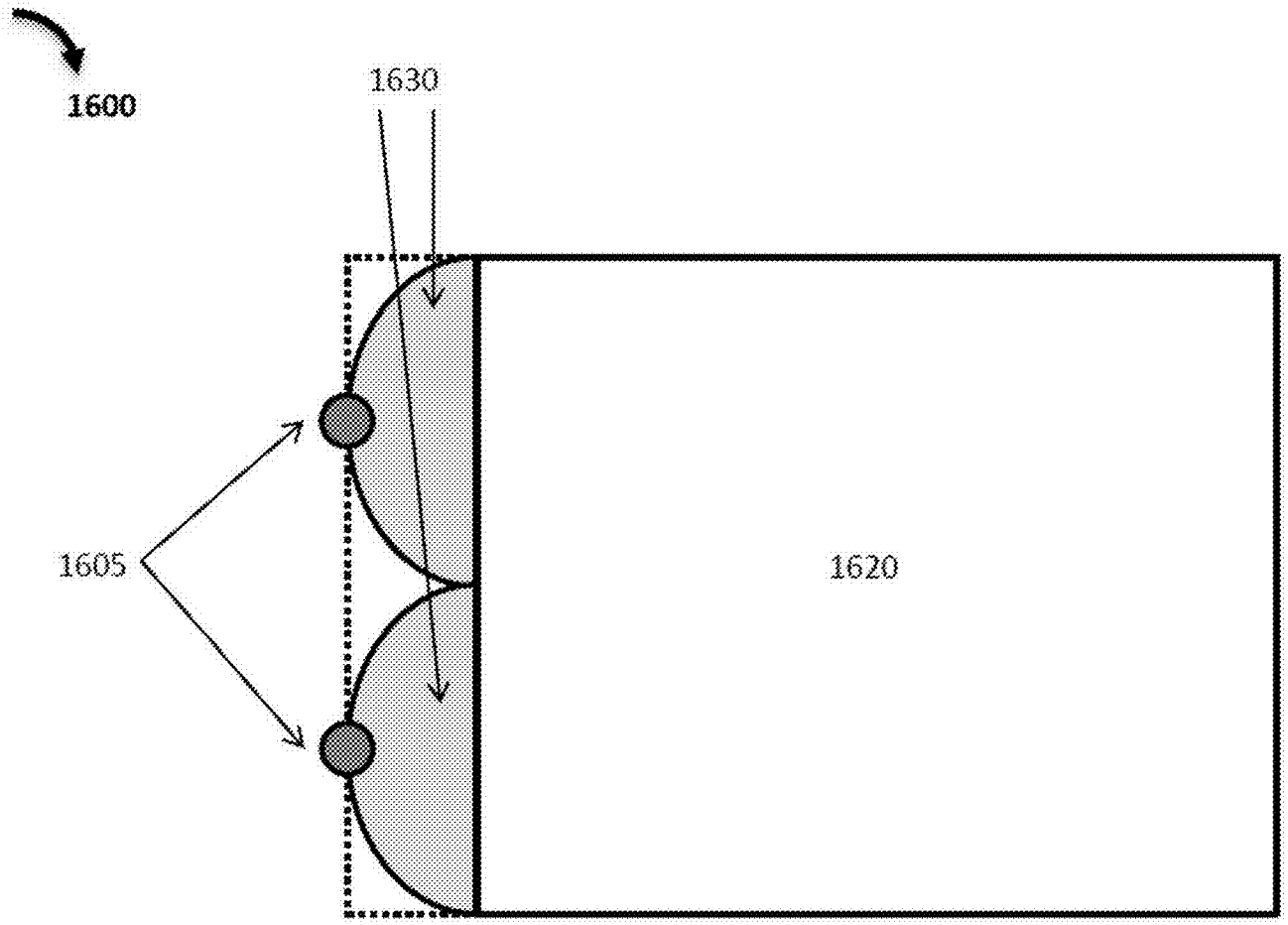
Figure 17:
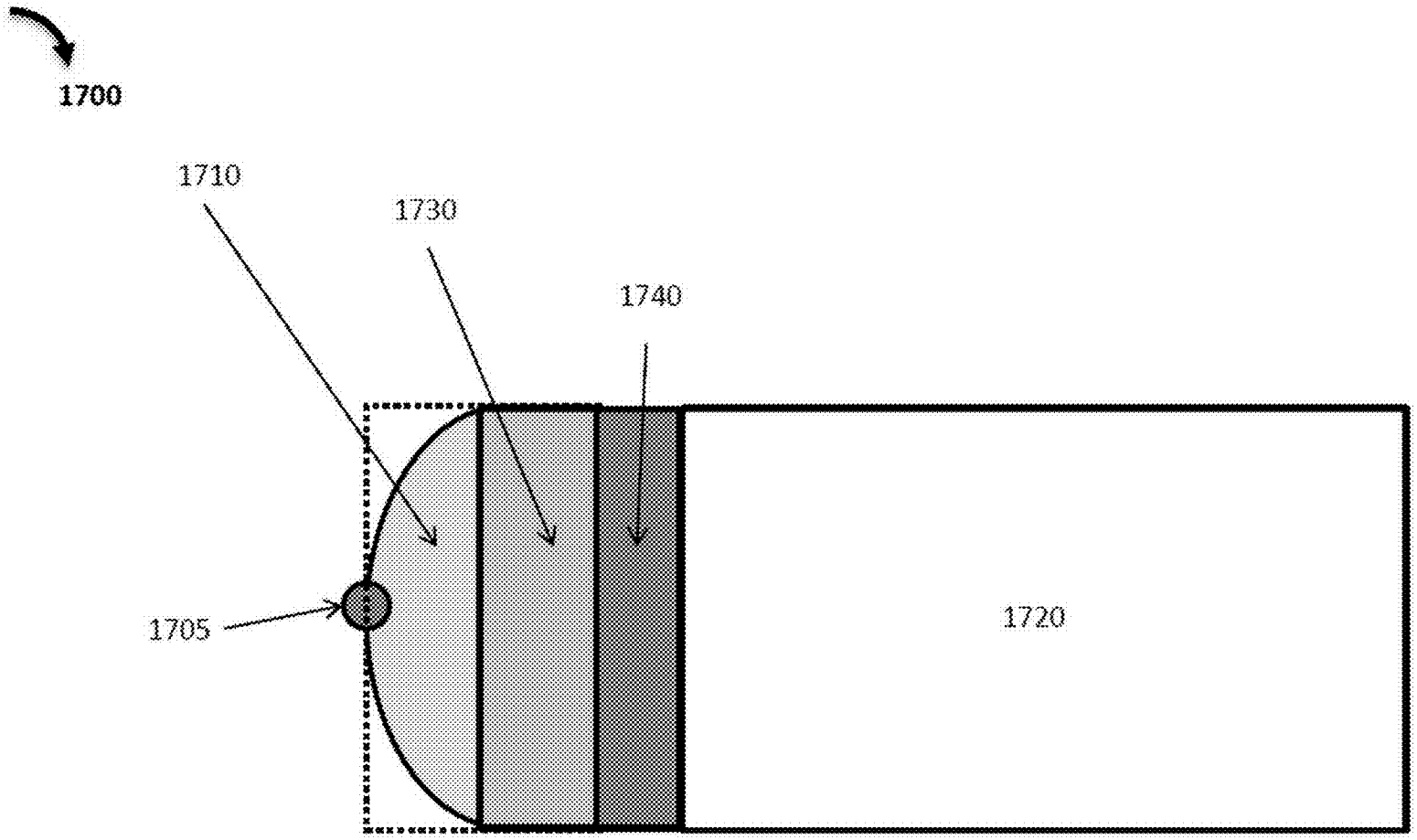
Figure 18:
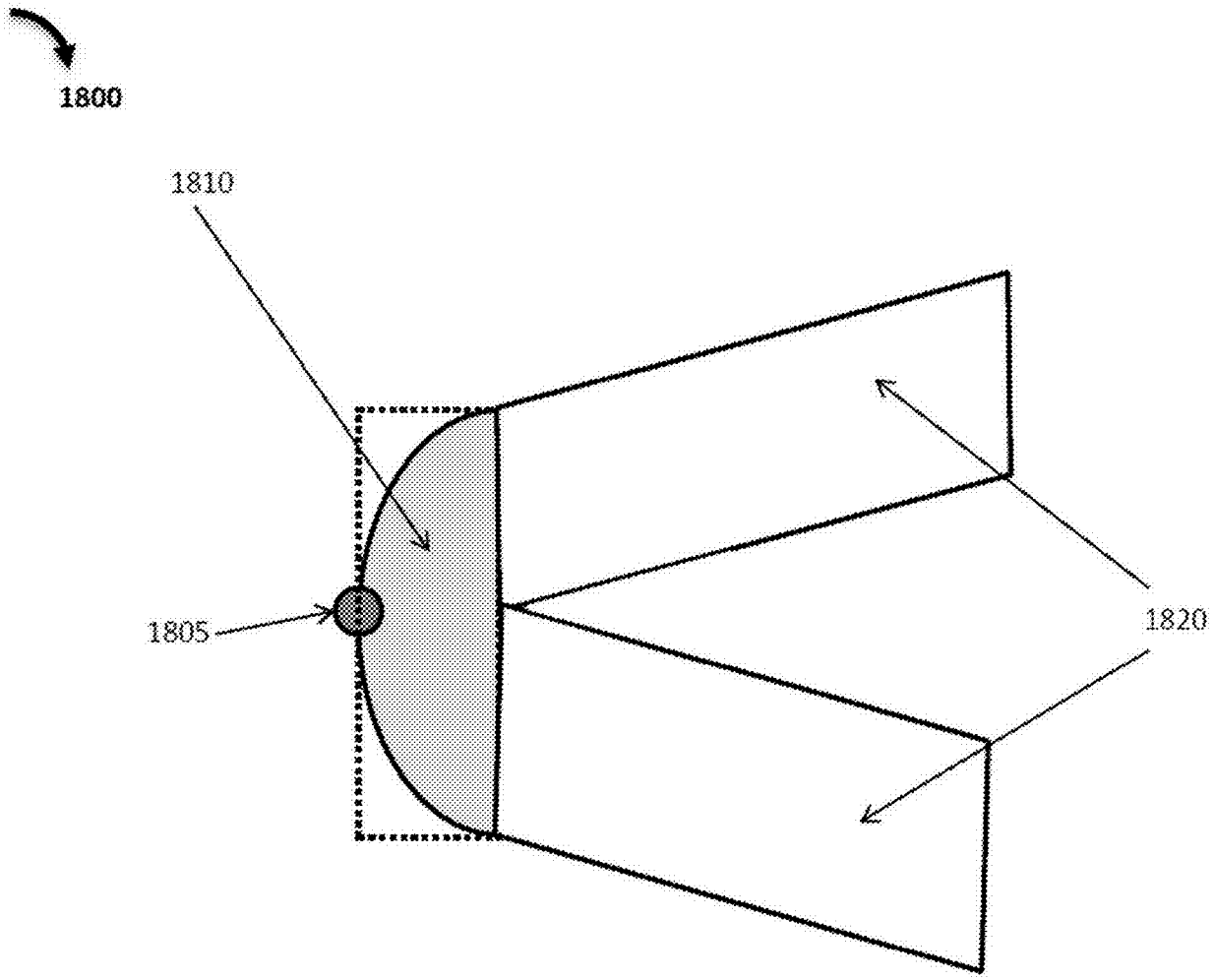
Figure 19:
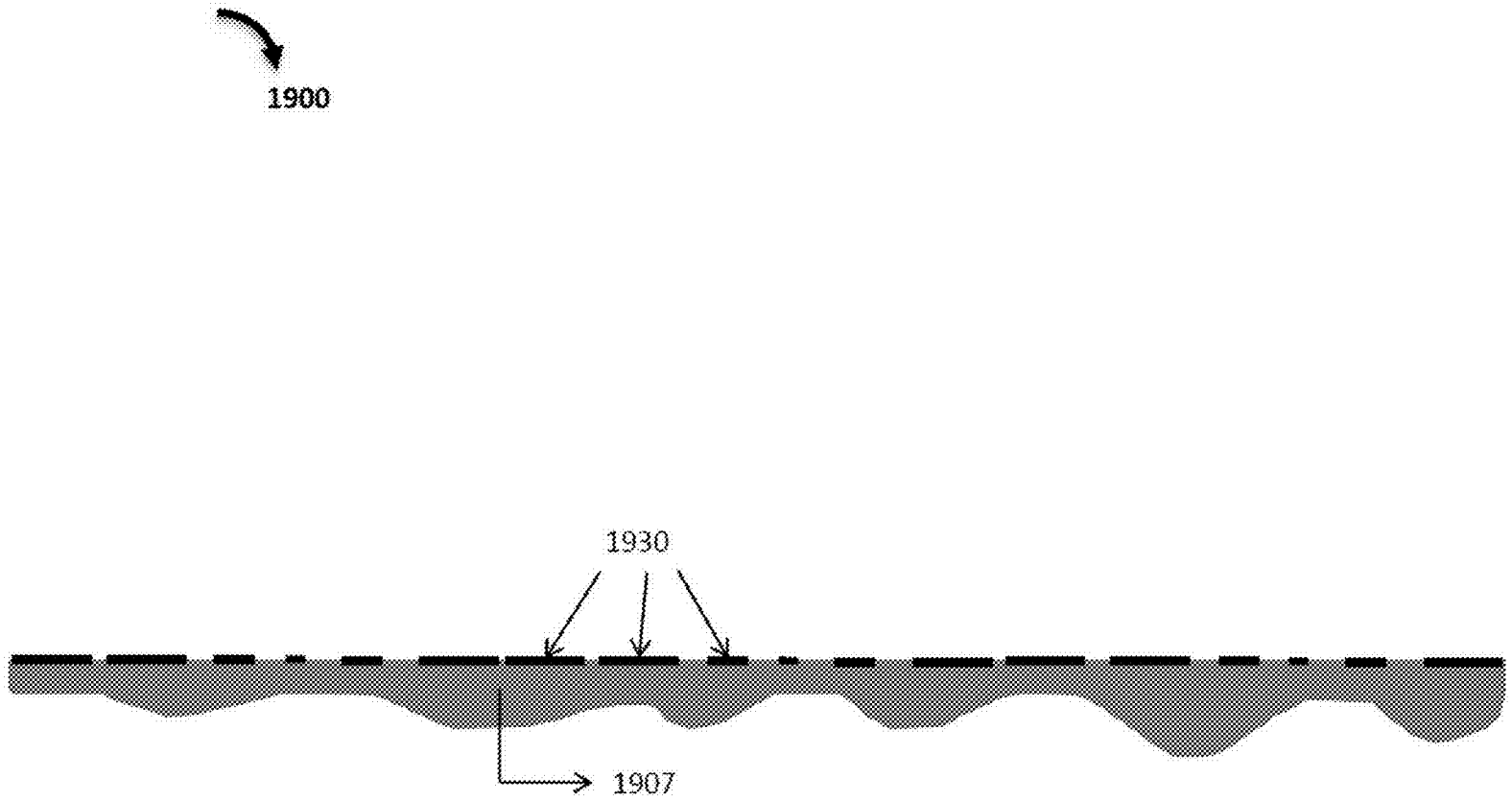
Figure 20:
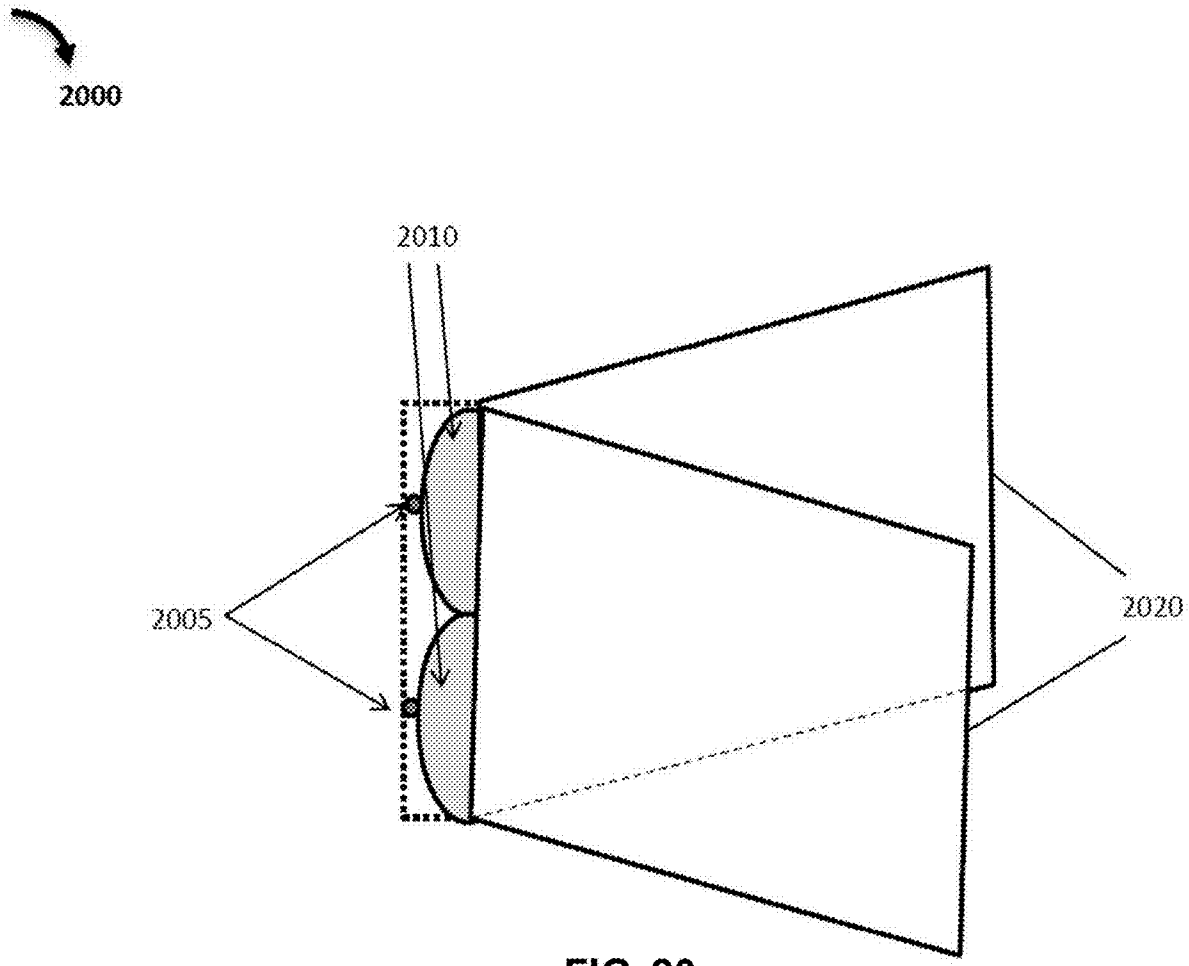

FIG. 11A illustrates a top view of surface impedance realization with square metallic patches of isotropic surface-wave AIS lens section attached to one-dimensionally modulated holographic radiation section, according to an embodiment of the present disclosure; FIG. 11B illustrates height and width profiles of the flat lens and the holographic sections, according to an embodiment of the present disclosure;

FIG. 12A and FIG. 12B illustrate examples of various types of unit cells to realize tensor (anisotropic) surface impedance distributions, according to an embodiment of the present disclosure; FIG. 12A illustrates how the slice width, slice angle, and edge gap size help determine the tensor surface impedance, according to an embodiment of the present disclosure; FIG. 12B illustrates additional examples of the various anisotropic (tensor) impedance unit cells, according to an embodiment of the present disclosure;

FIG. 13A and FIG. 13B illustrate availability of additional radiating area due to compactness of anisotropic surface-wave flat lens compared to isotropic surface-wave surface lens, according to an embodiment of the present disclosure;

FIG. 14 illustrates an anisotropic compact surface-wave flat lens section realized with anisotropic sliced metallic patches, attached to one-dimensionally modulated holographic radiation section realized with square metallic patches, according to an embodiment of the present disclosure;

FIG. 15A illustrates simulation results of various embodiments demonstrating how transforming a point-source feed into a surface plane wave via a surface-wave flat lens improves the efficiency of AIS holographic antennas by a factor of two and increases the gain by 3.6 dB for the chosen characteristics of the various design alternatives, according to an embodiment of the present disclosure; FIG. 15B illustrates a comparison of 2D holographic antenna with a surface-wave feed structure driven strip antenna, according to an embodiment of the present disclosure;

FIG. 16 illustrates a surface-wave feed structure with two-point feed system featuring two surface-wave lenses feeding a surface-wave antenna, according to an embodiment of the present disclosure;

FIG. 17 illustrates a surface-wave feed structure showcasing three cascading sections each with different functions, according to an embodiment of the present disclosure; The first section with the surface-wave lens transforms the point source into a plane surface-wave, the next section redistributes power, and the final one alters polarization before feeding the surface wave antenna;

FIG. 18 illustrates a surface-wave feed structure feeding two or more conformal surface-wave antennas, according to an embodiment of the present disclosure;

FIG. 19 illustrates a profile view of surface impedance realization with square metallic patches of isotropic surface lens section attached to one-dimensionally modulated radiation section, according to an embodiment of the present disclosure;

FIG. 20 illustrates two or more surface-wave feed structures feeding two or more conformal surface-wave antennas, according to an embodiment of the present disclosure.

DETAILED DESCRIPTION

It should be understood at the outset that, although example embodiments are illustrated below, the present invention may be implemented using any number of techniques, whether currently known or not. The present invention should in no way be limited to the example implementations, drawings, and techniques illustrated herein. Additionally, the drawings are not necessarily drawn to scale.

Feeding conformal surface-wave antennas with power, phase, and polarization distributions across the antenna surface such that they are optimal by some designer-defined metric is a challenging problem. An embodiment of the invention described herein is a compound structure consisting of a compact conformal surface-wave antenna feed structure attached to a conformal surface-wave antenna. The feed structure is an Artificial Impedance Surface (AIS) which takes as input an arbitrary source, converts it into a desired surface-wave waveform, which then feeds its output into the integrated conformal surface-wave antenna for optimal radiation performance.

Figure 1:
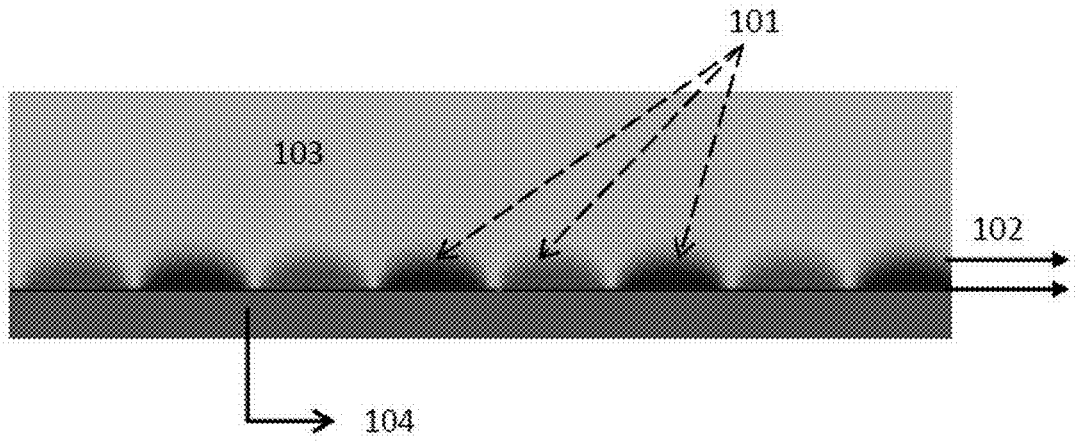

Certain terms used herein are described for the sake of clarity and to avoid confusion with similar but fundamentally different concepts and structures that are ubiquitous elsewhere. A surface-wave is a wave that propagates along a surface and whose amplitude decays exponentially away from the surface, as shown in FIG. 1). It is essentially like a 2D wave with a "thin" third dimension that exists mostly in the very close vicinity of the surface, similar to ripples on the surface of water. The term surface-wave lens refers to planar structures that work on surface-waves, whereas conventional lenses encountered at radio frequencies and in optics are three-dimensional structures that operate on 3D waves. In FIG. 1, the travelling surface wave 101, represented by red and blue contours, essentially exists only very close to the conformal surface 104, with its amplitude decaying exponentially away from the surface. Even when the surface is curved, such a wave can be viewed as a two-dimensional wave with a very compressed third dimension. Typically, 103 is free space. The direction of propagation is represented by 102. A lens structure is a structure that can change the direction of propagation. A flat lens structure is a lens structure that can make the incident waves come out parallel to each other as a planar wave. An isotropic lens structure is a lens structure that will create the same effect in all directions. An anisotropic lens structure is a lens structure that will not create the same effect in all directions.

Figure 2:
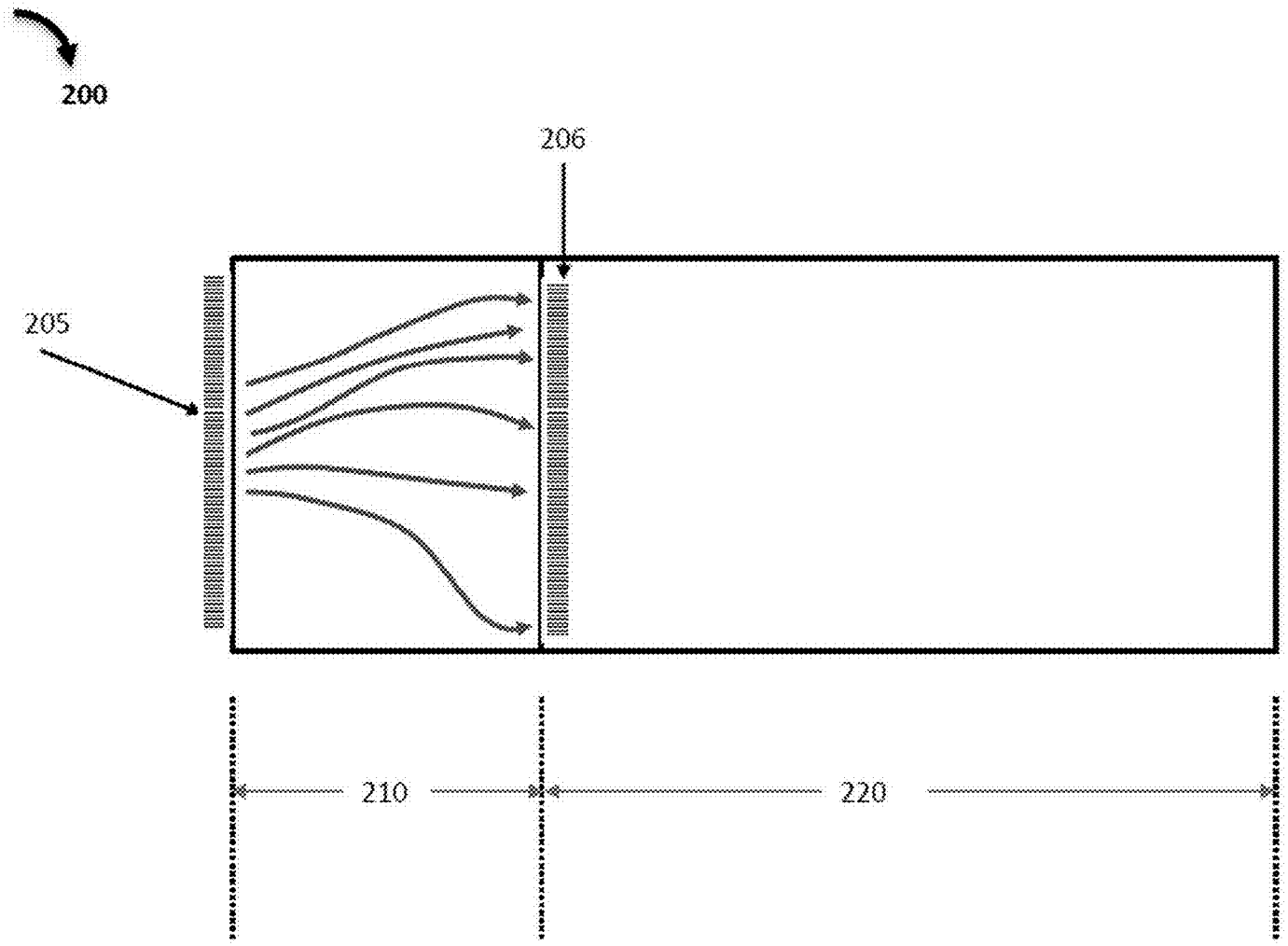
FIG. 2 illustrates an inventive concept where the compound structure has a flat lens section that planerizes the electromagnetic waves from the input sources and a second holographic antenna section that helps direct the radiation at a specified angle, according to an embodiment of the present disclosure.
Figure 3:
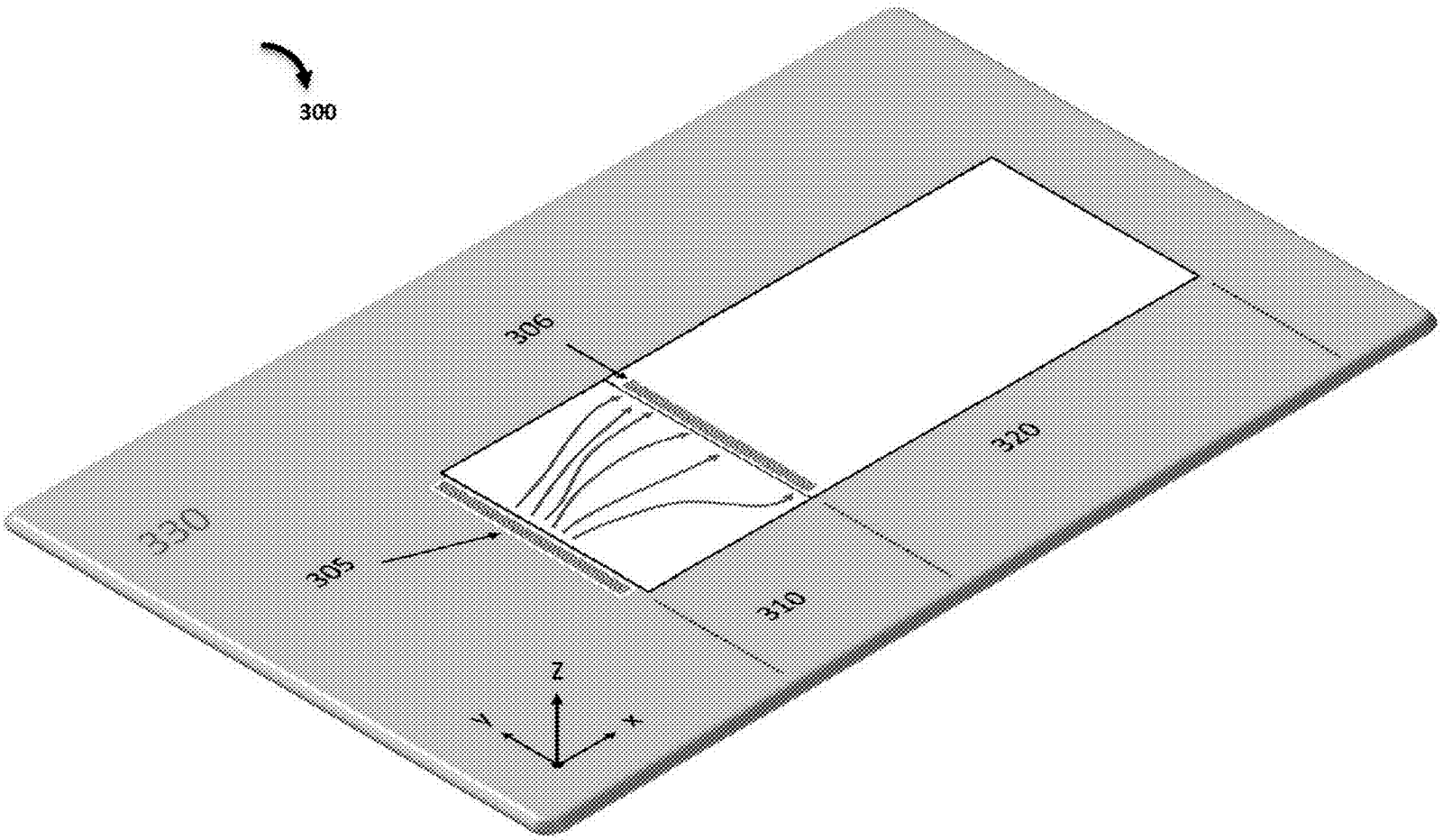
FIG. 3 illustrates a perspective view of planar compound structure consisting of a conformal surface-wave feed structure and a conformal surface-wave antenna, according to an embodiment of the present disclosure.

There is a need in the field of AIS antennas to improve significantly the performance of holographic AIS surface-wave antennas without increasing physical surface area. The system 200, according to an embodiment of this invention and as illustrated in FIG. 2, uses a compact and optionally anisotropic surface-wave feed structure 210 that takes an arbitrary feed 205 as input and transforms it into an arbitrary surface-wave at its output 206 such that the performance of the antenna it is connected to, is increased significantly. The surface wave at output 206 serves as input to a conformal surface wave antenna section 220. The two sections described above, namely the conformal surface wave feed structure 210 and the conformal surface wave antenna 220, can be implemented on a planar compound structure. System 300, demonstrates one such implementation on a conformal surface 330 according to an embodiment of this disclosure. FIG. 3 illustrates an isometric view of such an integrated compound structure implemented on a conformal surface 310. A surface wave feed input 305 is transformed to a 2D plane wave by the conformal wave feed structure 310 at the output 306, which serves as an input to the radiating surface 320.

Figure 4:
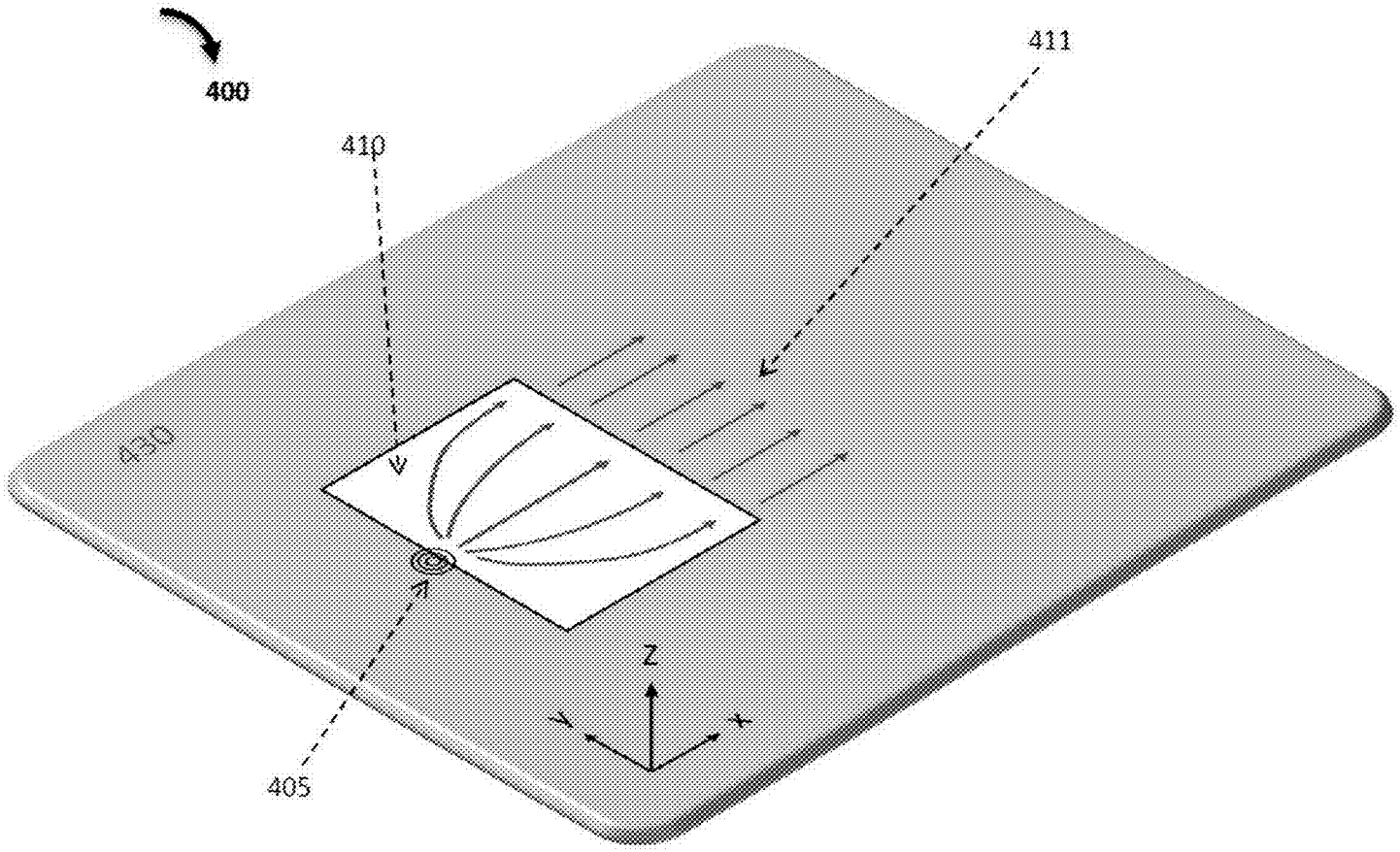
FIG. 4 illustrates the conversion of surface waves from the point source converted to planar waves using a thin planar lens feed structure, according to an embodiment of the present disclosure.
Figure 5:
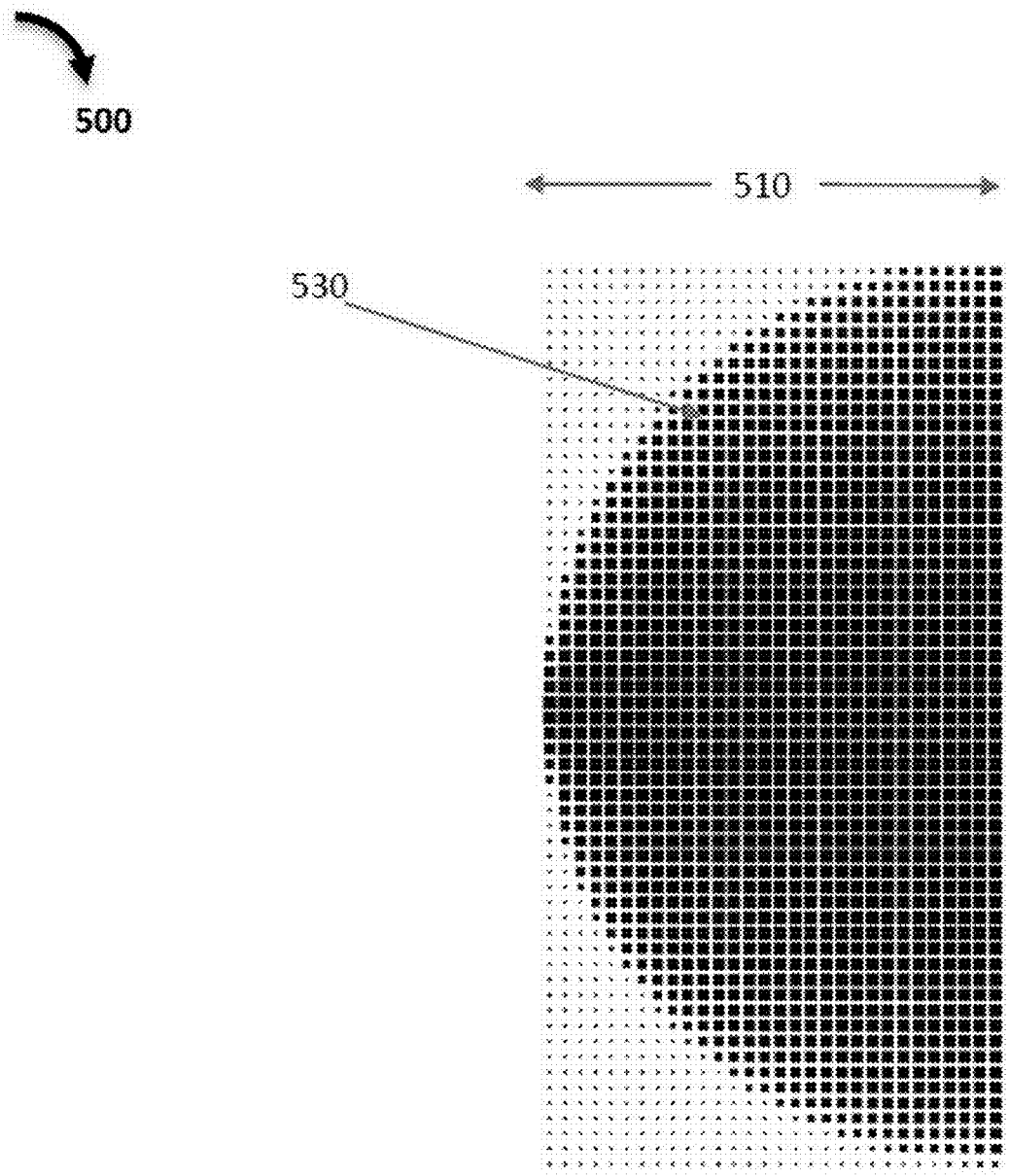
FIG. 5 illustrates realization of flat lens section with square metallic patches, according to an embodiment of the present disclosure.
Figure 6:
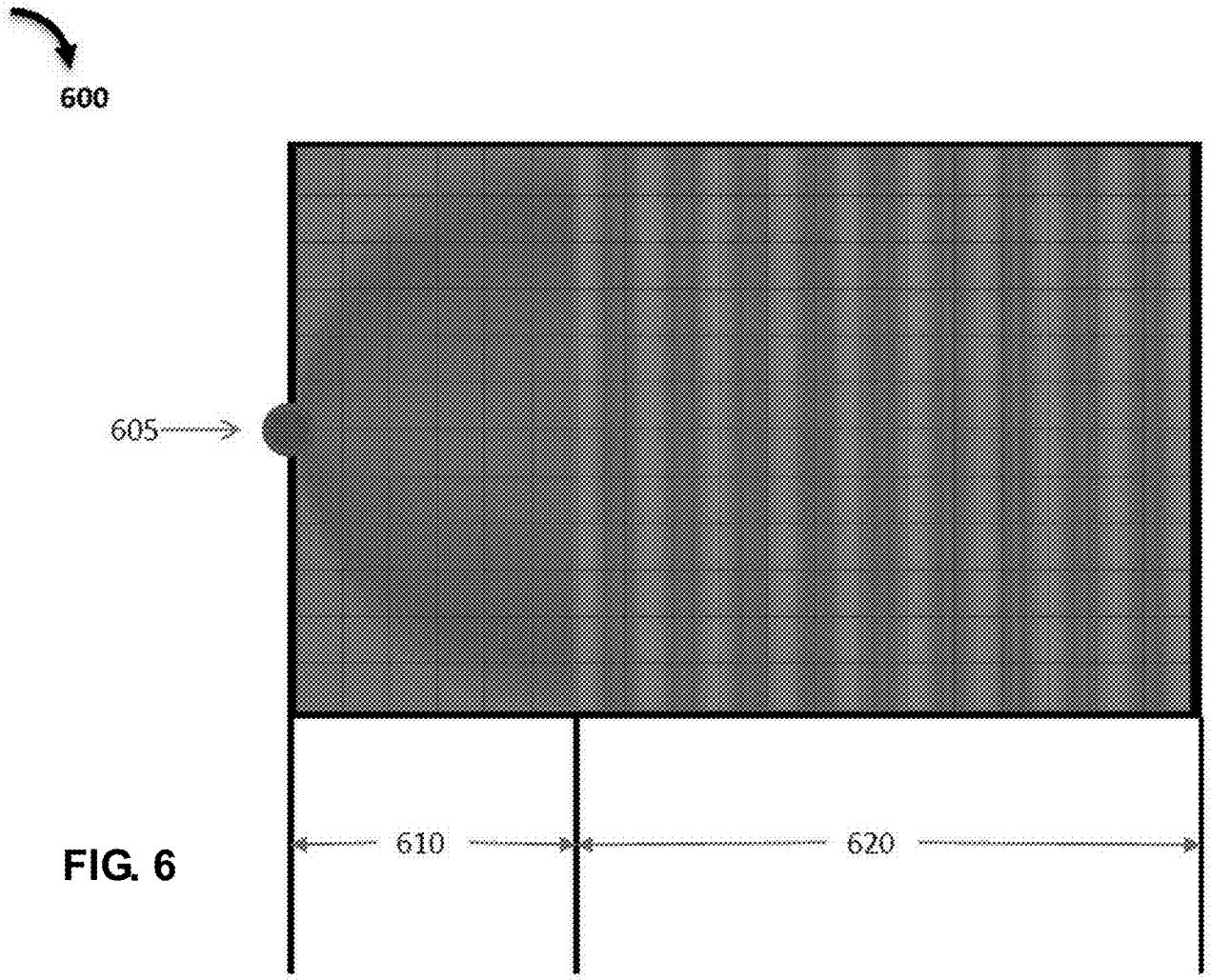
FIG. 6 illustrates an MS surface-wave lens feeding structure attached to a one-dimensionally modulated surface impedance holographic surface-wave antenna, according to an embodiment of the present disclosure.

We focus on one particular embodiment of this invention due to its wide applicability, namely how the performance of conformal holographic Artificial Impedance Surface (AIS) antennas driven by a single point-source—for example a coaxial line sticking out of its surface—can be improved substantially by using a surface-wave lens feed structure that transforms the cylindrical surface-wave of the source into a plane surface-wave that is then fed into a longitudinally modulated holographic surface for optimal radiation. An embodiment of this invention, system 400, illustrates this scenario. In FIG. 4, 405 is a point source sticking out of the conformal surface 430. The surface wave lens feed structure 410 transforms the cylindrical surface wave of the source to a plane surface wave 411. This lens feed structure is further detailed in System 500. In FIG. 5, 510 illustrates the realization of the flat lens structure with square metallic patches 530. The size, shape, make up and the gap size are some of the factors that determine the isotropic local surface impedance and are discussed in detail in FIG. 12. System 600 (FIG. 6) illustrates the compound surface according to an embodiment of this invention. In the system 600, the point source 605 is attached to the flat lens feed 610 that is made up of metallic patches discussed in FIG. 5, which is then attached to the one dimensionally (1D) modulated surface impedance holographic surface wave antenna 620. There are various sizes and shapes of 1D radiating holographic surface that may meet any given application need in terms of frequency, power, direction of radiation etc. The flat lens and the holographic surface can be made as an integrated compound surface and is scalable in size based on the application needs. These can serve as conformal antennas mounted on aircrafts, ships etc. to meet various mission needs as well as serve as compact radiating surfaces for many commercial applications. Such conformal antennas with coaxial line termination can be seamlessly integrated onto the surfaces of various vehicles with the single feed point, keeping the cost and the complexity down.

By using a compound structure consisting of a surface-wave lens attached to a one-dimensionally modulated radiation strip, one can improve the performance over the traditional two-dimensional modulated hologram approach. Performance can be improved even more by using another embodiment of this invention discussed in FIG. 14, namely anisotropic compact surface-wave flat lens that takes less space than an isotropic surface-wave lens, allowing the use of a larger radiating surface-wave antenna section for increased efficiency without increasing total antenna size (see FIG. 13 for comparison results).

Figure 7B:
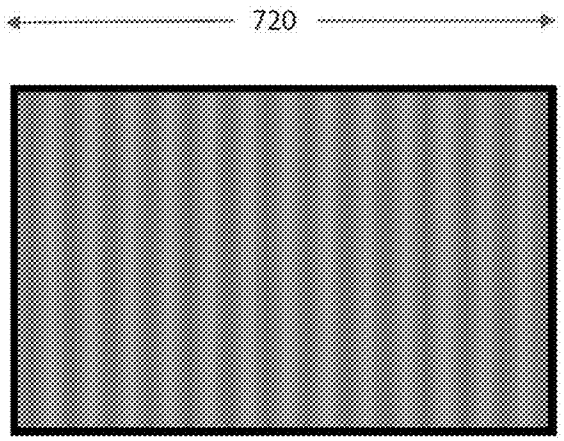
Figure 7A:
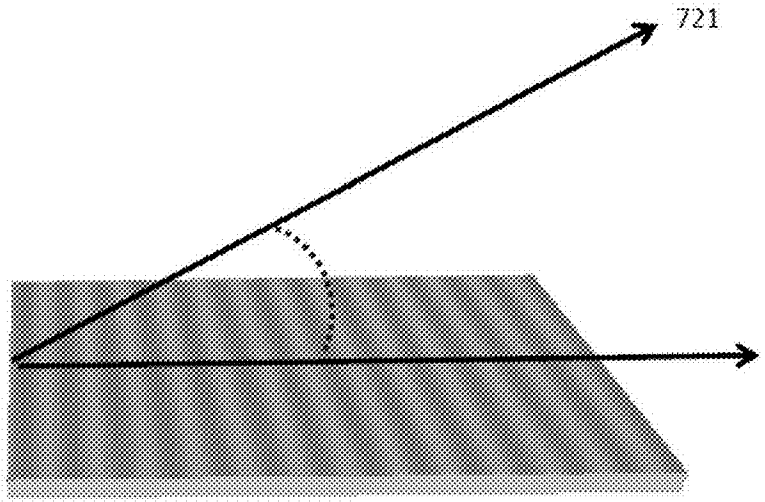

A holographic AIS antenna radiates optimally when the surface currents propagating on its aperture consist of a 2D plane surface-wave, being radiated by a holographic impedance surface 720 modulated in the prescribed radiation direction 721, and the impedance modulations are evenly distributed on the radiating surface as shown in FIG. 7A and FIG. 7B. But a single point-source creates a cylindrical surface-wave wave-front and a hologram created from such a source results in sub-optimal radiation efficiency. The embodiment 600 discussed earlier with a compact feed structure transforms efficiently a point source into a 2D surface plane wave in a very short distance, resulting in significantly improved antenna performance without additional physical surface area.

Figure 8:
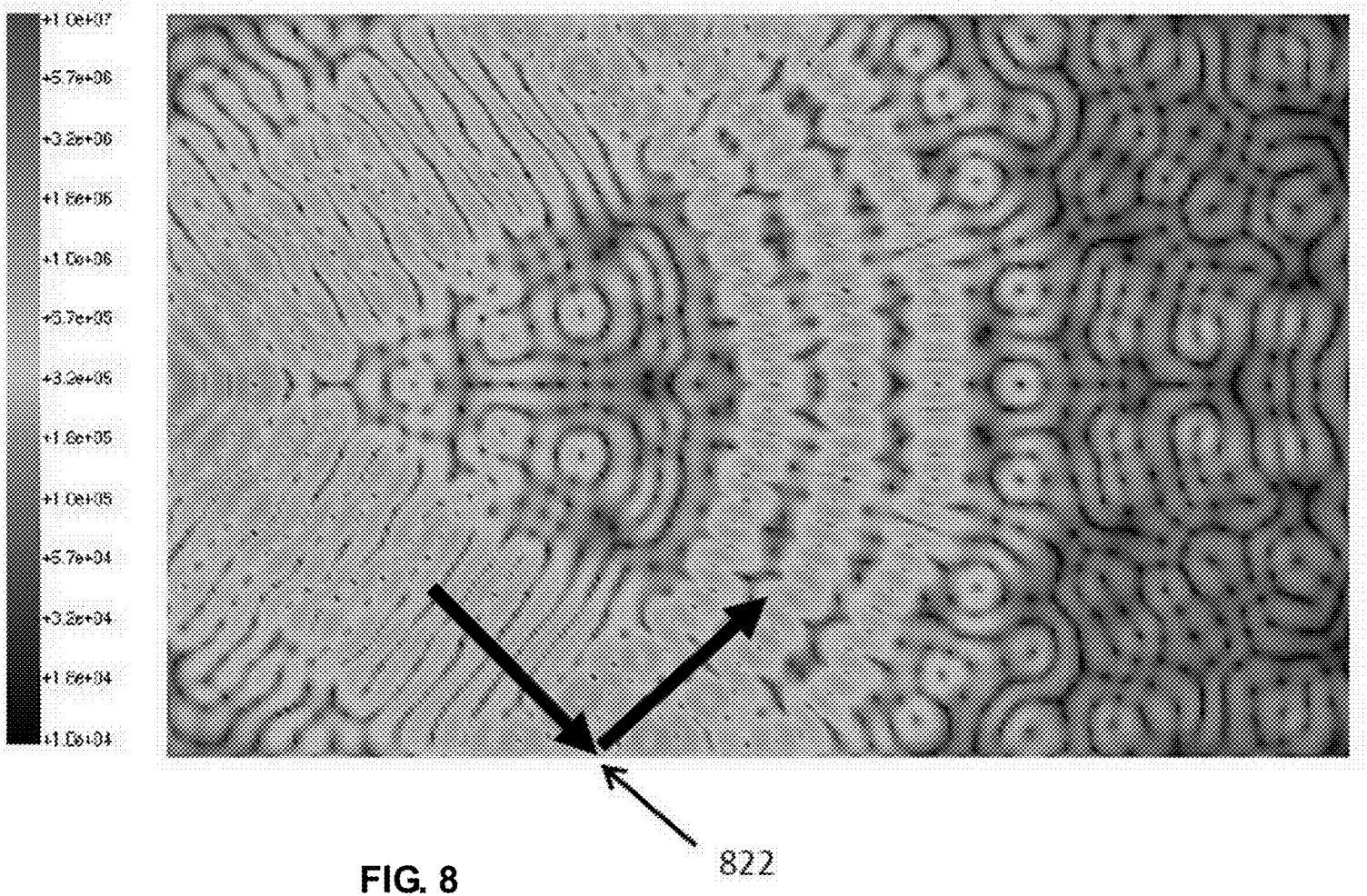
FIG. 8 illustrates simulation results showing surface currents of a traditional 2D-holographic antenna exhibiting edge reflections.
Figure 9:
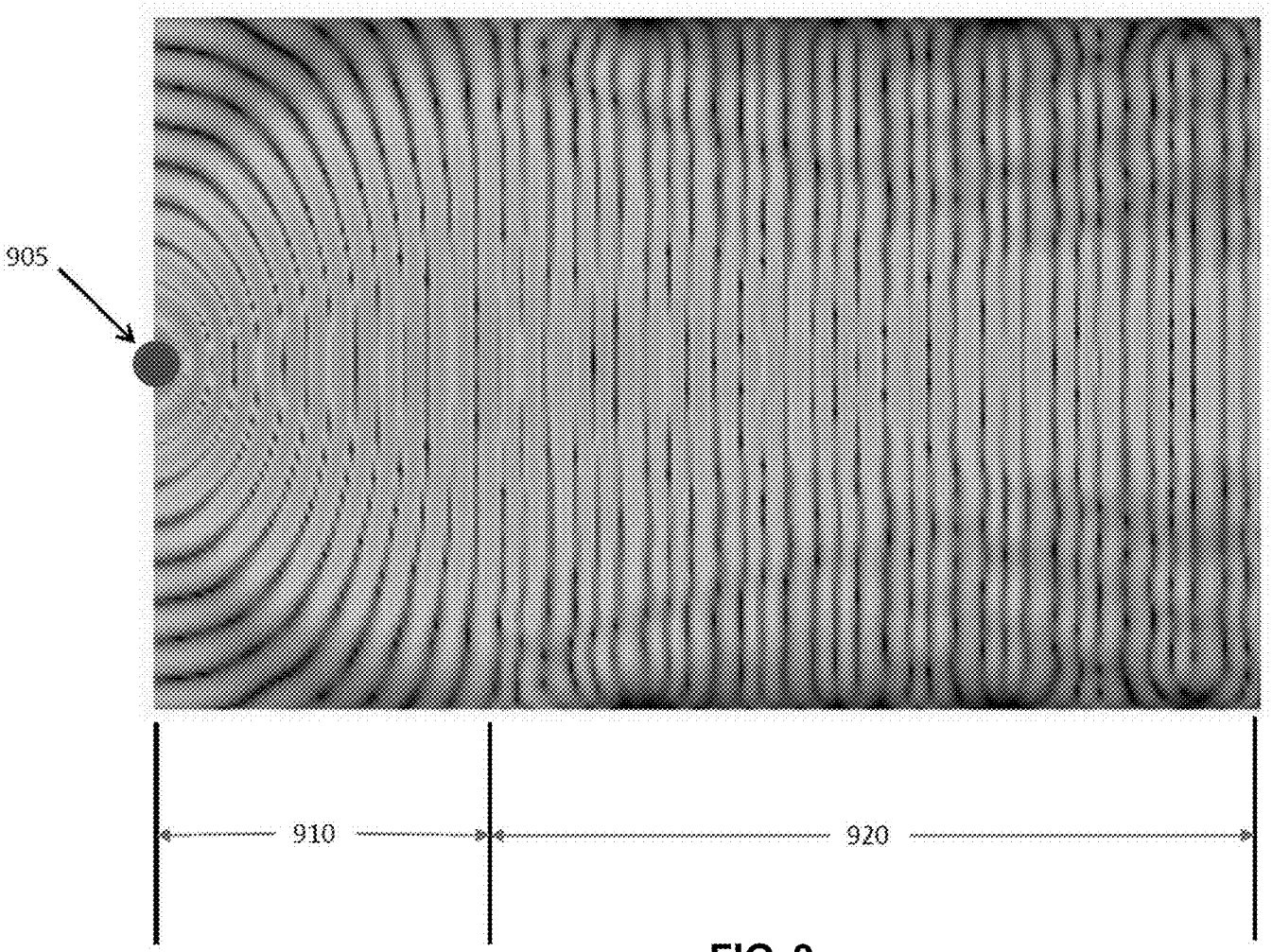
FIG. 9 illustrates simulation results of surface currents resulting from compound structure of FIG. 6, which consists of a surface-wave planar lens section and a 1D impedance modulated radiating section, according to an embodiment of the present disclosure.

FIG. 8 illustrates simulation results of surface currents of traditional 2D-holographic antenna exhibiting edge reflections from surface impedance distribution. Arrows 822 point to the effect of edge reflections. To solve this degradation due to edge reflections, the embodiment 600 described earlier has combined a compact AIS surface-wave lens to the one-dimensionally modulated aperture to create a compound structure that achieves near-optimal radiation efficiency and avoids the detrimental effects of edge reflections, without sacrificing much surface area. The resulting surface current distribution on the system is shown in FIG. 9. The FIG. 9 illustrates simulation results of surface currents resulting from this compound structure which consists of a surface-wave planar lens section 910 and a 1D impedance modulated radiating section 920, demonstrating how in the first section the cylindrical surface-wave is converted into a plane surface-wave which feeds the surface-wave antenna section 920. The currents exhibit minimal edge reflection and propagate in the direction of modulation. An embodiment of this design is shown to improve antenna gain by about 2.1 dB and raises aperture efficiency from 9.8% to 15.7%.

Figure 10B:
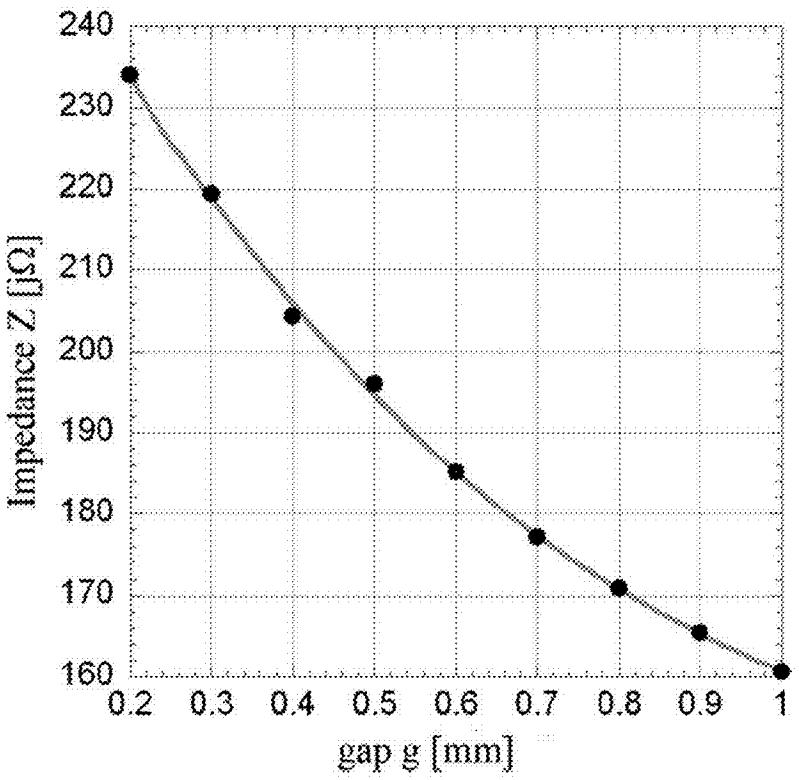
FIG. 10B illustrates simulation results of surface impedance values given as a function of gap size, according to an embodiment of the present disclosure.
Figure 10A:
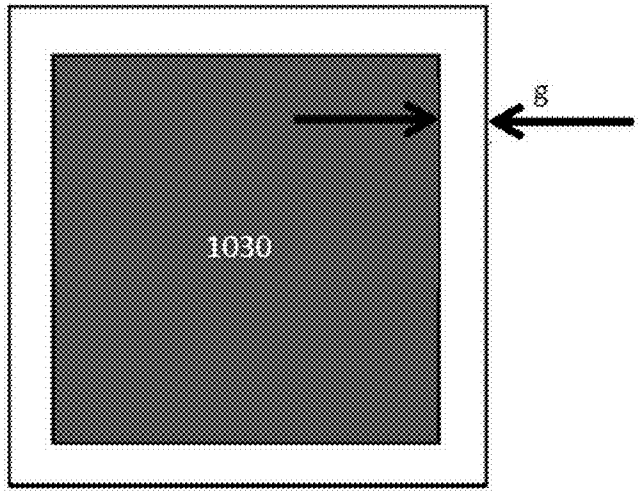
FIG. 10A illustrates a subwavelength metallic square patch atop a dielectric substrate with the gap size between patches determining isotropic local surface impedance, according to an embodiment of the present disclosure.

FIG. 10A illustrates a subwavelength square metallic patch 1030 atop a dielectric substrate with the gap size "g" between patches determining isotropic local surface impedance, according to an embodiment of the present disclosure. FIG. 10B illustrates simulation results of surface impedance values (jΩ) given as a function of gap size "g" in mm, according to an embodiment of the present disclosure.

The surface impedance distributions for both the flat lens section and the one-dimensional holographic modulation section can be realized with a metallic patterning over a dielectric substrate, consisting of subwavelength metallic patches as shown in another embodiment system 1100. FIG. 11A illustrates a top view of an embodiment of the system 1100. FIG. 11B illustrates height and width profiles of a holographic section, according to an embodiment of the system 1100. The planar surface-wave lens 1110 is designed to support a 10 GHz application and the length of this section is about 5" (about 4.2λ). The radiating hologram section 1120 is about 11" long (about 9.32λ) and about 10" wide (about 8.41λ) designed to support a 10 GHz operation. FIG. 11B, explodes the side view of the circled area of FIG. 11A, showing how the sizes of metallic patches are modulated to create the holographic patterns in system 1100.

System 1200 illustrates examples of metal patches according to an embodiment of the present disclosure. These examples serve as unit cells for both the flat lens section as well as the holographic radiating section. FIG. 12A and FIG. 12B illustrate examples of various types of unit cells of system 1200, to realize tensor (anisotropic) surface impedance distributions. FIG. 12A illustrates to a person skilled in the art that slice width, slice angle, and edge gap size can be used to determine the tensor surface impedance. FIG. 12B illustrates additional examples of the various anisotropic (tensor) impedance unit cells that can serve as unit cells in the system 1200.

Various other metallic patterning types which synthesize the desired local surface impedance can also be used, such as Jerusalem crosses. One practicing in the art will realize that this concept can be extended to various other shapes and sizes and this disclosure anticipates these extensions.

A method to realize the required sizes, shapes and quantities of metal patches that may be needed for any given application can be determined as illustrated below, according to an embodiment of this disclosure. For example, one would need only about twenty patch sizes to pick from to approximate the desired surface impedance at any point on the surface. The surface impedance distribution of the surface-lens section is governed by the following equation $$X_r = \sqrt{\left(\frac{L_o}{L_r}\right)^2 (1 + X_o^2) - 1}$$

Where $L_o$ is the length of the middle section of the lens, $L_r$ is the outer most length, $Z=-iX_o$ is the impedance along Lo and $Z=-iX_r$ is the impedance along $L_r$. This implies that a range of impedances needed is described by $$X_r = \sqrt{\left(\frac{2}{\pi}\right)^2 (1 + X_o^2) - 1}$$

where $2/\pi$ is the minimum of the lengths ratio $L_o/L_r$, and $X_o$ is necessarily the maximum value for X. For instance, if $X_r$=50 Ohms, then $X_o$=463.4 Ohms. A typical impedance range between 50 and 500 Ohms is sufficient to realize the entire surface-wave lens plus surface-wave antenna structure.

A much more compact lens has also been illustrated in the system 1300 (FIG. 13B), an embodiment of the present disclosure using tensor (anisotropic) surface impedance distributions. The equations describing the components of the impedance distribution are similar. Such tensor surface impedance distributions can be realized with a variety of patches such as those shown in system 1200. Again, a set of predesigned patches can be used to approximate the local tensor surface impedance or exactly sized patches can be directly printed on dielectric substrates. The compactness of the anisotropic flat lens illustrated in FIG. 13B, as compared to the isotropic lens illustrated in FIG. 13A, allows having a larger radiating area for the same total antenna size, as shown in FIG. 13A. 1315 in FIG. 13B illustrates the lens area saved by using the anisotropic flat lens structure and this saved area is now available for use as a radiating surface. A realization with sliced anisotropic metallic patches of the compact flat lens attached to a radiating section is illustrated in system 1400, another embodiment of the present invention.

FIG. 14 illustrates an anisotropic compact surface-wave flat lens section realized with anisotropic sliced metallic patches, attached to one-dimensionally modulated holographic radiation section realized with square metallic patches, according to an embodiment system 1400 of the present disclosure. In the system 1400 designed for a 10 GHz application, the anisotropic surface-wave flat lens 1410 uses a rectangular metal patch 1430 as illustrated. The width of this flat lens 1410 is about 2" (about 1.7λ). The radiating hologram section 1420 is designed with square metallic patches and has a width of about 10" ((about 8.4λ).

FIG. 15A illustrates simulation results of various embodiments demonstrating how transforming a point-source feed into a surface plane wave via a surface-wave flat lens improves the efficiency of AIS holographic antennas by a factor of two and increases the gain by 3.6 dB for the chosen characteristics of the different design alternatives, according to an embodiment of the present disclosure. The first row of FIG. 15A illustrates results for a conventional two dimensional holographic antenna for comparison purposes. The rows 2 and 3 shows the results of isotropic flat lens—radiating aperture combination illustrated in system 1100 of this invention. The row 4 of FIG. 15A illustrates the results of an anisotropic system 1400 of this invention. The summary of the results in FIG. 15A demonstrates how mating a compact surface-wave flat lens feed section to a one-dimensionally modulated holographic radiating section (row 2) doubles efficiency and increases gain by 2.1 dB compared to a two-dimensionally modulated holographic antenna with the same physical surface area (row 1). The third entry of the table in FIG. 15A is a design with the 1D radiation section having the same total surface area as the other antennas and provides an upper bound for how much gain can be improved. The compact surface-wave lens feed section antenna in the fourth row of the table comes very close to this upper bound. The embodiment in row-4, doubles aperture efficiency and provides 3.6 dBs of gain over the 2D-holographic antenna of row 1.

It can also be inferred from FIG. 15A that by using a compact anisotropic surface-wave flat lens as opposed to an isotropic one further improves aperture efficiency from 15.7% to 22.6% (while keeping total area the same), which is more than a factor of two better than the efficiency of 9.8% of the conventional two-dimensional holographic antenna of row-1. Antenna gain also increases by 1.5 dB over the isotropic lens design, for a total of 3.6 dB gain improvement over the two-dimensional holographic antenna. FIG. 15B illustrates a comparison of 2D holographic antenna with a surface-wave feed structure driven strip antenna, designed for a 10 GHz application with a 45-degree radar angle, according to an embodiment of the present disclosure.

Various other embodiments of the disclosed invention are possible. For instance, the surface-wave feed structure can consist of two surface-wave lenses for a two or more source feed system feeding a surface-wave antenna, as shown in embodiment 1600 of this invention. FIG. 16 illustrates a surface-wave feed structure with two-source feed system 1630 featuring two point sources 1605 as source feeds, the two surface-wave lenses 1630 feeding a surface-wave antenna 1620.

The surface-wave antenna can be of any type of antenna, such as a leaky wave antenna or a holographic antenna. The surface-wave feed structure can consist of cascaded sections (FIG. 17) as illustrated in the system 1700, an embodiment of this invention. The system 1700 uses a point source feed 1705, followed by three sections of the feed structure 1710, 1730 and 1740, each performing a different function, such as transforming the point source into a plane surface-wave (1710), the next section redistributing power (1730), and the final one altering polarization before feeding the surface wave antenna (1740). The feed structure is integrated with any holographic radiating section 1720.

Additional embodiments 1800 and 2000 are illustrated in FIG. 18 and FIG. 20 respectively. They comprise of one (1805) or more (2005) point sources connected to one (1810) or more (2010) surface-wave feed structures, feeding two or more surface-wave antennas 1820 and 2020. One skilled in the art can expand this concept to include many combinations and structures based on various embodiments presented here to suit the needs of various applications and these combinations and structures are anticipated by this invention.

The realization of the impedance surface need not be for a dielectric substrate of uniform thickness. The substrate can have variable thickness as illustrated in the system 1900. FIG. 19 illustrates a thin substrate 1907 with a non-uniform thickness with the required surface impedance realization with square metallic patches 1930. The square metallic patches 1930 can be laid out as illustrated in FIGS. 11*a* and 11*b* to form the planar surface lens section 1110 attached to one dimensionally modulated radiation section 1120. Again, many variations of this embodiment can be envisioned with this inventive concept by one skilled in the art to meet any specific application needs.

A method of making the compound structure of the various embodiments described above comprises having a thin dielectric substrate of desired uniform or of varying cross sections first mounted on a ground plane that is conformal to the mounting surface, mounting the metallic patches of desired shapes and sizes on the substrate with any of the mounting techniques known to one in the art, and applying the necessary coatings to protect the compound surface followed by the necessary curing process. The dielectric substrate can be monolithic and can include the various sections discussed in the various embodiments as needed and can include the mounting area for the source or sources, the flat lens feed structure as described earlier and the holographic radiating aperture section with the required size and pattern as discussed earlier—all on the same substrate. Additional variations can be generated with this concept by one skilled in the art.

Modifications, additions, or omissions may be made to the systems, apparatuses, and methods described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order. As used in this document, "each" refers to each member of a set or each member of a subset of a set.

To aid the Patent Office, and any readers of any patent issued on this application in interpreting the claims appended hereto, applicants wish to note that they do not intend any of the appended claims or claim elements to invoke paragraph 6 of 35 U.S.C. Section 112 as it exists on the date of filing hereof unless the words "means for" or "step for" are explicitly used in the particular claim.

What is claimed is:

1. A conformal surface-wave feed structure, comprising: a conformal surface-wave lens section that feeds a surface wave onto a surface-wave antenna from a single point source connected to the conformal surface-wave lens without a tapered transmission line.

2. The feed structure of claim 1, wherein the lens section is made up of artificial impedance surface (AIS) unit cells.

3. The feed structure of claim 2, wherein the AIS unit cells are square metallic patches and at least a portion of the square metallic patches each has an anisotropic impedance along a first axis parallel to a direction of propagation compared to a second axis perpendicular to the first axis and lying within the lens section.

4. The feed structure of claim 1, wherein the lens section converts a circular wave feed to a surface-wave feed and avoids signal degradation from edge reflections.

5. The feed structure of claim 2, wherein the lens section has an isotropic impedance distribution along a first axis parallel to a direction of propagation compared to a second axis perpendicular to the first axis and lying within the lens section and outputs surface-waves.

6. The feed structure of claim 2, wherein the lens section has an anisotropic impedance distribution along a first axis parallel to a direction of propagation compared to a second axis perpendicular to the first axis and lying within the lens section and outputs surface-waves.

7. A compound structure comprising:

one or more conformal surface-wave flat lens section(s) connected to one or more source feed(s) on one end, and one or more surface-wave antenna(s) connected to the other end of the flat lens section(s), wherein the flat lens section(s) converts the source feed(s) to one or more plane surface-waves and the source feed(s) do not include a tapered transmission line.

8. The compound structure of claim 7, wherein the flat lens section(s) are made up of artificial impedance surface (AIS) unit cells.

9. The compound structure of claim 7, wherein the flat lens section(s) are made up of metal square patches made up of artificial impedance surface (AIS) materials.

10. The compound structure of claim 7, wherein the surface-wave antennas are radiating holograms.

11. The compound structure of claim 10, wherein both the flat lens section(s) and the surface-wave antennas are made up of artificial impedance surface (AIS) unit cells.

12. The compound structure of claim 1, wherein the flat lens section(s) have an anisotropic impedance distribution along a first axis parallel to a direction of propagation compared to a second axis perpendicular to the first axis and lying within the flat lens section and outputs surface-waves.

13. The compound structure of claim 7, further comprising a power redistribution section and a polarization control section located between the output of the flat lens section and the input to the surface-wave antennas.

14. The compound structure claim 7, wherein the source feed(s) are point sources.

15. A method of making a compound structure comprising:

mounting a dielectric substrate on a ground plane that is conformal to a mounting surface, and mounting metal patches made up of Artificial Impedance Surface (AIS) materials, wherein the metal patches are laid out to serve as a cascade of flat lens section operatively coupled to a holographic one dimensionally modulated antenna section that conveys a surface wave from a single point source without the presence of a tapered transmission line.

16. The method of claim 15 further comprising interfacing the compound structure to more than one point sources for efficient transfer of input energy.

17. The method of claim 15 further comprising applying a protective coating.

18. The method of claim 15 wherein the substrate is monolithic.

19. A method of realizing an isotropic impedance distribution comprising:

computing the desired lensing function, selecting size, shape and material of artificial impedance surface (AIS) unit cells, and computing gaps between unit cells and the number of unit cells needed to realize the desired lensing function, and laying the unit cells in a shape necessary to provide the necessary isotropic impedance function on a dielectric substrate, wherein the lensing function transforms a source wave from a single point source to a plane surface-wave without the presence of a tapered transmission line.

20. A conformal compound surface comprising:

a planar surface wave artificial impedance surface (AIS) flat lens attached to a point source at one end without the presence of a tapered transmission line, and a AIS radiating hologram attached to the other end of the flat lens, wherein both the flat lens and the radiating hologram are made up of metal patches of various sizes and wherein the flat lens converts the point source feed to a plane surface wave.

21. The compound surface of claim 20, wherein the flat lens has an anisotropic impedance distribution along a first axis parallel to a direction of propagation compared to a second axis perpendicular to the first axis and lying within the flat lens.

22. The compound surface of claim 20, wherein the metal patches are square.

23. A conformal surface-wave feed structure comprising:

a conformal surface-wave lens section comprising anisotropic patches, wherein each anisotropic patch has an anisotropic impedance distribution along a first axis parallel to a direction of propagation compared to a second axis perpendicular to the first axis and lying within the anisotropic path, wherein the conformal surface-wave lens section is configured to change a direction of propagation of a surface-wave travelling along the surface-wave lens section, and the conformal surface-wave feed structure is configured to change a wavefront of the surface-wave.

24. The conformal surface-wave feed structure of claim 23, wherein the surface wave is a cylindrical surface-wave; and wherein the lens section(s) is configured to convert the cylindrical surface-wave to a plane surface-wave.

25. The conformal surface-wave feed structure of claim 23, wherein the conformal surface-wave feed structure is configured to receive an electromagnetic wave from a single point source and output surface waves onto two or more surface-wave antennas directed in different directions.

26. The conformal surface-wave feed structure of claim 1, wherein the conformal surface-wave lens feeds a second surface wave from a second single point source connected to the conformal surface-wave lens without a tapered transmission line onto a surface-wave antenna.

* * * * *